US009346652B2

(12) United States Patent
Noumi et al.

(10) Patent No.: US 9,346,652 B2
(45) Date of Patent: May 24, 2016

(54) FILM WINDING CORE, AND WOUND FILM BODY USING SAME

(75) Inventors: Shunsuke Noumi, Osaka (JP); Shunichirou Sayanagi, Osaka (JP)

(73) Assignee: Nitto Denko Corporation, Osaka (JP)

( * ) Notice: Subject to any disclaimer, the term of this patent is extended or adjusted under 35 U.S.C. 154(b) by 142 days.

(21) Appl. No.: 14/004,336

(22) PCT Filed: Mar. 9, 2012

(86) PCT No.: PCT/JP2012/001667

§ 371 (c)(1), (2), (4) Date: Sep. 10, 2013

(87) PCT Pub. No.: WO2012/124304

PCT Pub. Date: Sep. 20, 2012

(65) Prior Publication Data

US 2014/0001298 A1 Jan. 2, 2014

(30) Foreign Application Priority Data

Mar. 11, 2011 (JP) ..... 2011-054158

(51) Int. Cl.
*B65H 75/20* (2006.01)
*B65H 75/08* (2006.01)
(Continued)

(52) U.S. Cl.
CPC ..... *B65H 75/08* (2013.01); *B65H 18/28* (2013.01); *B65H 75/04* (2013.01); *B65H 75/10* (2013.01); *B65H 2701/1752* (2013.01); *B65H 2701/37* (2013.01); *B65H 2701/535* (2013.01)

(58) Field of Classification Search
CPC .... B65H 75/08; B65H 75/10; B65H 2701/37; B65H 2701/514
USPC ..... 242/604, 604.1, 610.6, 613, 613.2, 242/118.11, 118.2
See application file for complete search history.

(56) References Cited

U.S. PATENT DOCUMENTS 866,613 A 9/1907 Arnold
2,278,380 A * 3/1942 Malkomes et al. ..... 242/603
(Continued)

FOREIGN PATENT DOCUMENTS

CA 1 059 095 7/1979
DE 1 168 204 4/1964
(Continued)

OTHER PUBLICATIONS

Japanese office action with English translation from corresponding Japanese application No. 2011-054158, issued Jun. 16, 2015, 4 pages.
(Continued)

*Primary Examiner* — Sang Kim
(74) *Attorney, Agent, or Firm* — Hamre, Schumann, Mueller & Larson, P.C.

(57) ABSTRACT

A film winding core (10) of the present invention includes a bearing portion (12), a plurality of blade portions 13, and a plurality of film supporting portions (14). The bearing portion (12) constitutes a tubular portion into which a shaft used to rotate the film winding core (10) is to be inserted. The plurality of blade portions (13) are provided respectively at a plurality of positions in a rotational direction of the bearing portion (12) and respectively extending outwardly from the bearing portion (12) so as to partition a space around the bearing portion (12) in the rotational direction. The plurality of film supporting portions (14) are respectively provided at positions outward from leading edges of the blade portions (13), and has an outwardly protruding shape so that a film (18) is supported away from the film winding core (10) between the film supporting portions (14) that are adjacent to each other in the rotational direction.

11 Claims, 10 Drawing Sheets

(51) Int. Cl.

| | |
|---|---|
| ***B65H 75/04*** | (2006.01) |
| ***B65H 75/10*** | (2006.01) |
| ***B65H 18/28*** | (2006.01) |

(56) References Cited

U.S. PATENT DOCUMENTS

| | | | | |
|---|---|---|---|---|
| 2,457,786 | A | 12/1948 | Slayter | |
| 2,605,978 | A * | 8/1952 | Allard | 242/613.2 |
| 3,396,918 | A | 8/1968 | Adamson et al. | |
| 3,540,669 | A | 11/1970 | Schmidt et al. | |
| 3,627,220 | A | 12/1971 | Vogel | |
| 4,657,202 | A * | 4/1987 | Sauber | 242/577.1 |
| 4,919,358 | A | 4/1990 | Innocenti, Sr. et al. | |
| 5,915,062 | A * | 6/1999 | Jackson et al. | 385/137 |
| 6,405,974 | B1 | 6/2002 | Herrington | |
| 6,460,796 | B1 * | 10/2002 | Berning et al. | 242/407.1 |
| 2007/0275183 | A1 * | 11/2007 | Hashimoto | 428/1.2 |
| 2014/0001306 | A1 | 1/2014 | Noumi et al. | |

FOREIGN PATENT DOCUMENTS

| | | |
|---|---|---|
| EP | 0 007 383 | 2/1980 |
| GB | 2 422 593 | 8/2006 |
| JP | 32-005233 | 6/1957 |
| JP | 47-002810 | 1/1972 |
| JP | 55-026193 | 2/1980 |
| JP | 56-063010 U | 4/1981 |
| JP | 9-050096 | 2/1997 |
| JP | 2004-075385 | 3/2004 |
| JP | 2009-113877 | 5/2009 |
| WO | 98/49985 | 11/1998 |
| WO | 99/19238 | 4/1999 |
| WO | 01/44088 | 6/2001 |
| WO | 2005/000494 | 1/2005 |

OTHER PUBLICATIONS

Office Action for corresponding European Patent Application No. 12757690.8, Sep. 24, 2015, 6 pages.

* cited by examiner

FILM WINDING CORE, AND WOUND FILM BODY USING SAME

TECHNICAL FIELD

The present invention relates to a film winding core and a wound film body using the core.

BACKGROUND ART

A long film is produced by a known method such as extrusion molding and wound on a cylindrical core for storage and shipment. The film thus wound on the cylindrical core is distorted (deformed) during storage, which may cause difficulties in unwinding the film. For example, Patent Literature 1 points out such a problem.

Patent Literature 1 describes a core configured to prevent the distortion of a belt-like article resulting from the contraction of the wound article. Specifically, after the belt-like article is wound on the core in close contact with the outer periphery of the core, the core is contracted in the radial direction thereof. Then, after the core is expanded in the radial direction to increase the contact between the outer periphery of the core and the belt-like article, the belt-like article is unwound from the core.

CITATION LIST

Patent Literature

Patent Literature 1: JP 2009-113877 A (FIG. 5 to FIG. 10)

SUMMARY OF INVENTION

Technical Problem

Since the core described in Patent Literature 1 has a relatively complex mechanism, it is not suitable for sale to customers in the form of a roll of film wound on the core.

It is an object of the present invention to provide a simple technique for preventing defects in unwinding the film.

Solution to Problem

The present invention provides a film winding core on which a long film is to be wound. This film winding core includes: a tubular bearing portion into which a shaft used to rotate the film winding core is to be inserted; a plurality of blade portions provided respectively at a plurality of positions in a rotational direction of the bearing portion, the plurality of blade portions respectively extending outwardly from the bearing portion so as to partition a space around the bearing portion in the rotational direction; and a plurality of film supporting portions respectively provided at positions outward from leading edges of the blade portions, the plurality of film supporting portions having an outwardly protruding shape so that the film is supported away from the film winding core between the film supporting portions that are adjacent to each other in the rotational direction.

In another aspect, the present invention provides a wound film body including: the film winding core of the present invention; and a film wound on the film winding core of the present invention.

Advantageous Effects of Invention

To the inventors' knowledge, a film is distorted based on the following mechanism. Depending on the production method of the film, along film has not a little thickness unevenness (variations in the thickness) in a width direction. When such a film is wound on a conventional cylindrical core, a thick portion of the film expands outward more than a thin portion thereof. Then, tension is concentrated on the thick portion, and the thick portion is stretched in the longitudinal direction. On the other hand, sufficient tension is not applied to the thin portion, and so-called "gapping" occurs in some cases. "Gapping" refers to the formation of a gap between the inner layer and the outer layer of the wound film. In the case where the film is wound on the core and then the wound film is stored in a temperature environment in which the film contracts, a gapped portion of the film contracts in the longitudinal direction to remove the gap. As a result, distortion between the thick portion and the thin portion increases. This makes a difference in the longitudinal length between the thick portion and the thin portion.

This distortion is memorized in the film. Therefore, the film is unwound from the core while keeping the distortion. Then, sufficient tension is not applied to the thick portion, which causes a slack in the thick portion. This phenomenon is most obvious when the tension applied to the film is not high enough to unwind the film. The slack in the film causes errors in feeding the film, and reduces the yield of film-related products and the availability of the film.

According to the present invention, the blade portions extend outwardly from the bearing portion, and the film supporting portions are provided at positions outward from the leading edges of the blade portions. The film supporting portions have an outwardly protruding shape so that the film is supported away from the film winding core between the film supporting portions that are adjacent to each other in the rotational direction. Such a configuration makes it possible to prevent as much as possible the film from coming into close contact with the core and the distortion from being memorized in the film. Therefore, the bend or slack in the film can be prevented during unwinding of the film. As a result, stable feeding of the film can be achieved during unwinding thereof, and thus the incidence of manufacturing defects (feeding errors) can be reduced significantly. The yield of film-related products and the availability of the film are also improved.

DESCRIPTION OF EMBODIMENTS

Hereinafter, embodiments of the present invention will be described with reference to the accompanying drawings. Hereinafter, in this description, the film winding core is simply referred to as a "core".

Figure 1:
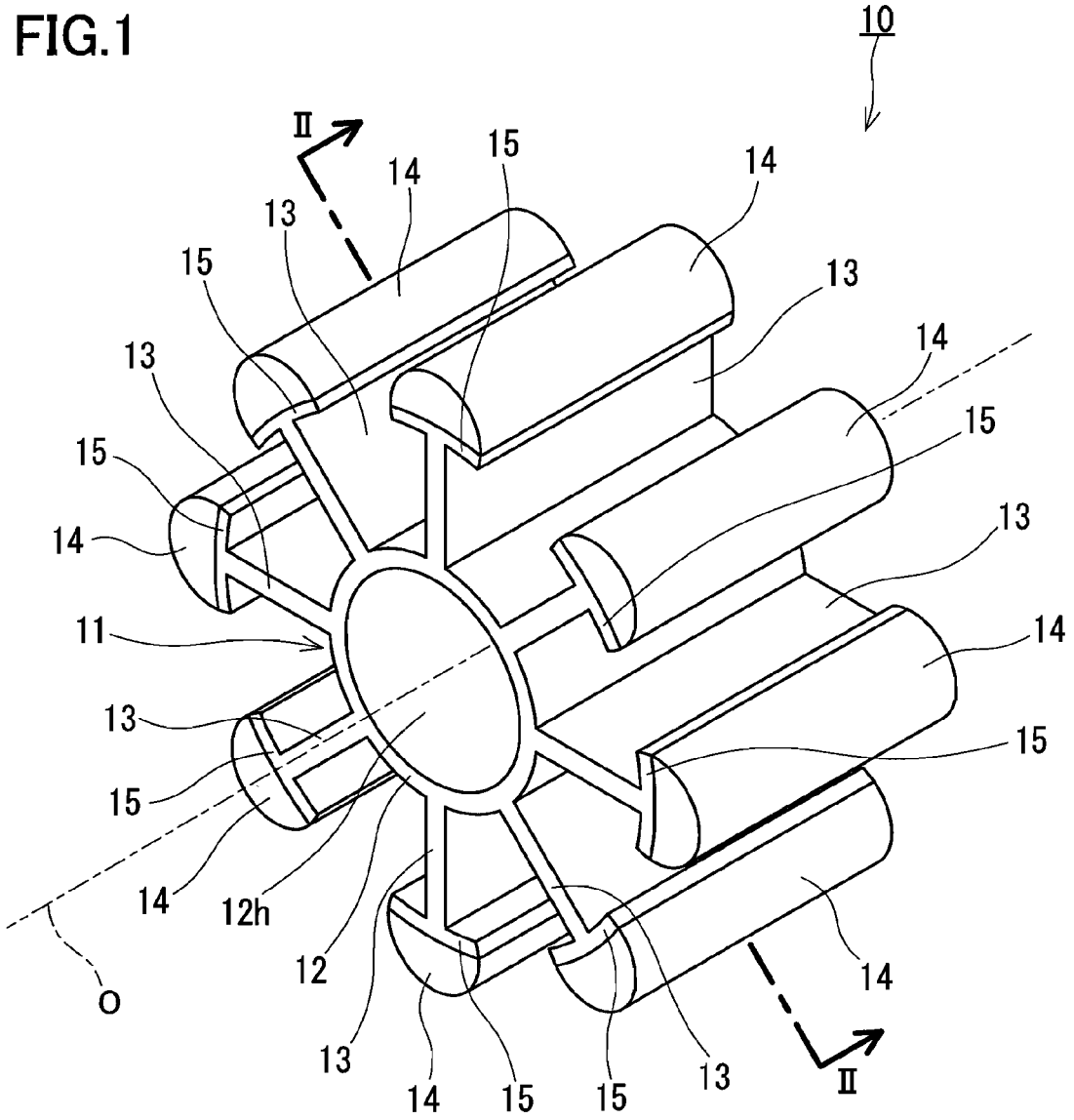
FIG. 1 is a perspective view of a film winding core according to an embodiment of the present invention.
Figure 2:
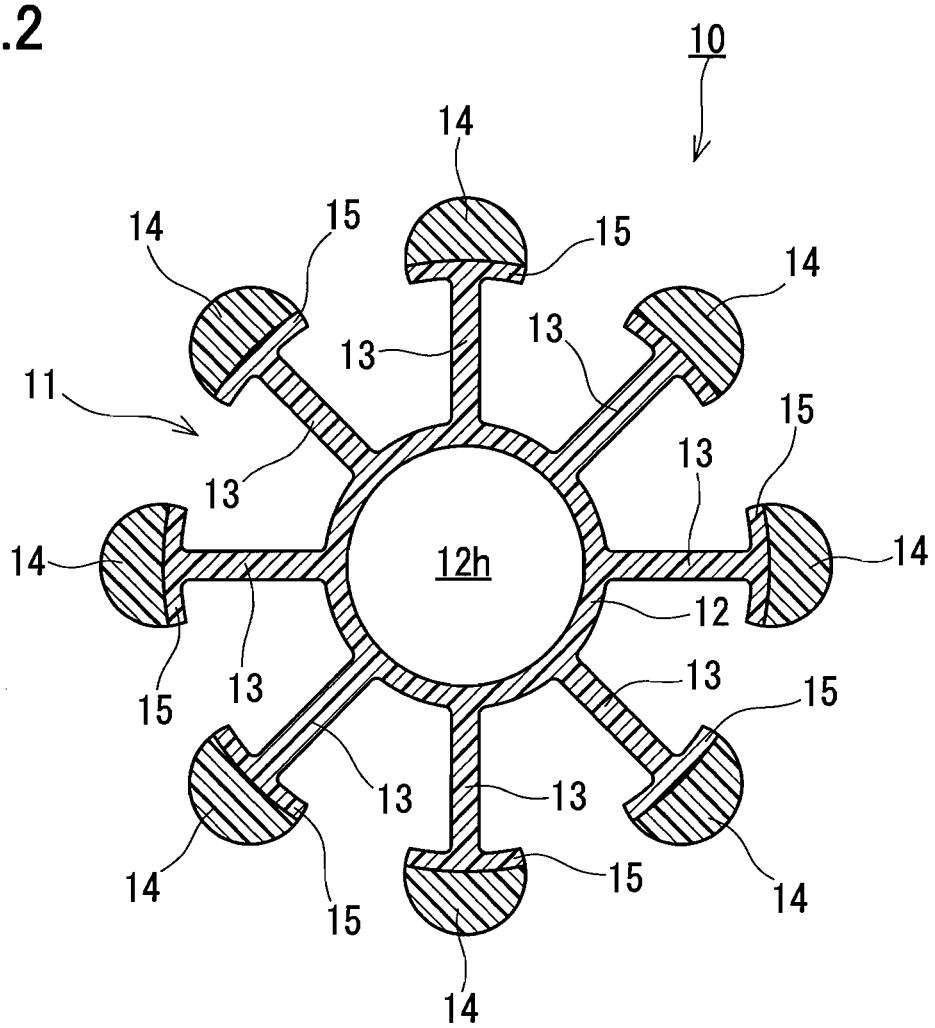
FIG. 2 is a cross-sectional view of the core shown in FIG. 1, taken along the line II-II.
Figure 3:
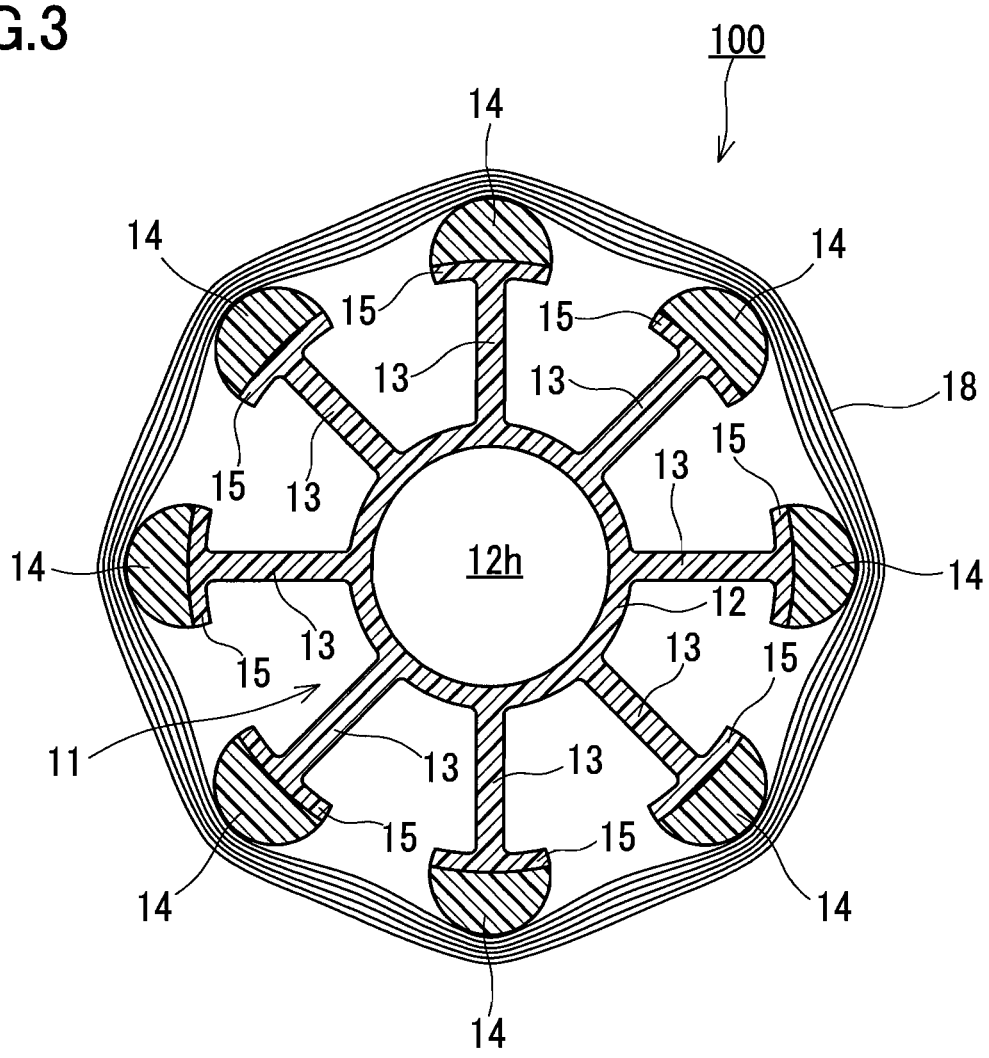
FIG. 3 is a cross-sectional view of a wound film body using the core shown in FIG. 1.

As shown in FIG. 1 and FIG. 2, a core 10 is composed of a core body 11 and a plurality of film supporting portions 14 mounted on the core body 11. The core body 11 is composed of a bearing portion 12 having a bearing hole 12*h*, a plurality of blade portions 13, and a plurality of rim portions 15. As shown in FIG. 3, a wound film body 100 includes the core 10 and a long film 18 wound on the core 10. The core 10 can be rotated about a rotational axis O passing through the bearing hole 12*h*.

The bearing portion 12 is a portion into which a shaft (not shown) used to rotate the core 10 is to be inserted, and has a cylindrical shape. The cross-sectional shape of the bearing portion 12 is not particularly limited, and it may be a circle as in the present embodiment, or it may be a polygon. In this core 10, the film 18 is supported directly by the film supporting portions 14. Furthermore, as described later, the influence of the uneven thickness of the film 18 is cancelled out by the film supporting portions 14. Therefore, a high dimensional accuracy is not required for the core body 11. As used in this description, the "bearing portion 12" may not have a function of supporting the shaft, to be exact. The term "bearing portion" is used in the sense of "a portion having a through-hole (bearing hole 12*h*) for mounting the core 10 on the shaft".

The blade portions 13 are provided respectively at a plurality of positions in the rotational direction of the bearing portion 12, and respectively extend outwardly from the bearing portion 12 so as to partition the space around the bearing portion 12 in the rotational direction. In the present embodiment, the blade portions 13 extend radially from 8 positions on the outer peripheral surface of the bearing portion 12. The interval (angular interval) between the blade portions 13 that are adjacent to each other in the rotational direction is constant. The number of the blade portions 13 is not particularly limited as long as the number of the blade portions 13 provided on the core 10 is more than one. The blade portions 13 have a rectangular plate shape. The rim portion 15 is located on one of the opposite sides of the blade portion 13, and the bearing portion 12 is located on the other side of the blade portion 13.

The rim portion 15 is a portion located on the leading edge (one side) of the blade portion 13. In the present embodiment, one rim portion 15 is provided on the leading edge of one blade portion 13. The rim portions 15 each have an arc-shaped surface. The rim portions 15 each face the bearing portion 12 in the radial direction. One set of the blade portion 13 and the rim portion 15 has an approximately "T" shape in the cross-section orthogonal to the rotational axis O. The rim portions 15 that are adjacent to each other in the rotational direction are spaced from each other. The space between the blade portions 13 that are adjacent to each other in the rotational direction is radially outwardly open. The film supporting portions 14 are fixed to the rim portions 15 by a known method such as welding and bonding. This configuration makes it possible to reliably avoid the close contact between the film 18 and the bearing portion 12 between two film supporting members 14 that are adjacent to each other in the rotational direction. Thus, it is possible to prevent the distortion from being memorized in the film 18.

Preferably, the core body 11 has sufficient rigidity. In the present embodiment, the bearing portion 12 and the plurality of blade portions 13 are integrally formed by injection molding. That is, the core body 11 is formed of a single component. Therefore, the rigidity of the core body 11 can be ensured relatively easily and the production cost of the core body 11 can be reduced. The bearing portion 12 and the plurality of blade portions 13 may be separate components, of course. The bearing portion 12 and the plurality of blade portions 13 may be formed of a single component, and the plurality of rim portions 15 may be formed of other components different from the single component. Instead, the bearing portion 12, the plurality of blade portions 13 and the plurality of rim portions 15 may be integrally formed by injection molding.

Preferably, the core body 11 is made of a resin suitable for injection molding. Desirably, the core body 11 is not easily deformed when the film 18 is wound on the core 10. Typically, a thermoplastic resin, such as polycarbonate, polypropylene, polyethylene, acrylonitrile-butadiene-styrene copolymer, polyester (for example, polyethylene terephthalate, polyethylene naphthalate or the like), polystyrene, or polyvinyl chloride, can be used as a material for the core body 11. The whole or a part of the core body 11 may be made of an inorganic material such as metal, ceramic, or glass.

As shown in FIG. 1 and FIG. 2, the film supporting portions 14 are respectively provided at positions outward from the leading edges of the blade portions 13 around the core body 11. The film supporting portions 14 have a radially outwardly protruding shape so that the film 18 is supported away from the core 10 between the film supporting portions 14 that are adjacent to each other in the rotational direction. The close contact between the film 18 and the bearing portion 12 can be avoided between the film supporting portions 14 that are adjacent to each other in the rotational direction. Thus, it is possible to prevent the distortion from being memorized in the film 18.

In the present embodiment, one film supporting portion 14 is provided for one blade portion 13. That is, one film supporting portion 14 is provided for one set of the blade portion 13 and the rim portion 15. However, the core 10 may have a different number of the film supporting portions 14 from the number of the blade portions 13.

In the present embodiment, the film supporting portions 14 are made of a material that can be deformed when the film 18 is wound on the core 10. Specifically, the film supporting portions 14 are made of an elastically deformable material. When the film supporting portions 14 are elastically deformable, sufficient friction can be generated between the film supporting portions 14 and the film 18. Therefore, free rotation of the core 10 can be prevented when the film 18 is wound and unwound. In addition, since the film supporting portions 14 have appropriate elastic and cushioning properties, the influence of the uneven thickness of the film 18 can be alleviated or offset effectively.

Typically, at least one material selected from the group consisting of sponge, rubber, and foam can be used as a material for the film supporting portions 14. These materials are all inexpensively available and easy to process. These materials also allow sufficient friction to act between the film 18 and the film supporting portions 14. For example, since urethane foam has the above-mentioned properties in a well-balanced manner, it is recommended as the material for the film supporting portions 14. Materials having appropriate impact resilience are, for example, natural rubber, nitrile rubber, silicone rubber, and foams of these. Besides these materials, polyethylene, EVA (ethylene-vinylacetate copolymer), EPDM (ethylene-propylene-diene rubber), fluorine rubber, and foams of these also can be used. The film supporting portions 14 can be fixed to the core body 11 by a known method such as bonding or welding.

Only a portion of the film supporting member 14, for example, a portion in contact with the film 18 may be made of any one of the above materials. The film supporting portions 14 may be integrated with the core body 11 by injection molding.

As shown in FIG. 1, the film supporting portions 14 are provided so as to extend from one side of the core body 11 to the other side thereof. The longitudinal direction of the film supporting portion 14 is parallel to the rotational axis O of the core 10. In the wound film body 100 (FIG. 3), the longitudinal direction of the film supporting portion 14 is perpendicular to the longitudinal direction of the film 18. This configuration allows a uniform supporting force to be applied to the film 18 in the width direction of the film 18.

In the present embodiment, the film supporting portion 14 has a semicircular column shape. This shape allows the film supporting portion 14 to have a reasonably large surface area for supporting the film 18. This is preferred from the viewpoint of preventing a local deformation of the film 18.

Since the core 10 of the present embodiment does not have a mechanically movable portion, it can be produced at low cost.

As shown in FIG. 3, the wound film body 100 has a polygonal shape, typically a regular polygonal shape, as a whole, in the cross-section perpendicular to the rotational axis O (or in plan view). Portions of the film 18 wound on the core 10 that are not supported by the film supporting portions 14 are slightly slackened toward the bearing portion 12. The film 18 is separated from the core 10 between the film supporting portions 14 that are adjacent to each other in the rotational direction.

The material, structure and dimensions of the film 18 to be wound on the core 10 are not particularly limited. However, the use of the core 10 of the present embodiment for winding a film having thickness unevenness inherent thereto is very effective in suppressing the distortion. For example, a film produced using an extruder equipped with a T-die has an approximately uniform width-direction thickness distribution in any portion of the film measured in the longitudinal direction. For example, it is assumed that there is a thickness difference of about 1 μm between one end of the film and the other end thereof in the width direction. When this film is wound 1000 turns on a conventional cylindrical core, a diameter difference of about 2 mm is created between one end of the resulting wound film body and the other end thereof. Even such slight thickness unevenness increases the diameter difference in the resulting wound film body as the number of winding turns increases. As a result, the distortion due to the uneven thickness is memorized in the film, which increases the probability of unwinding defects (typically feeding errors).

The core 10 of the present embodiment is particularly effective in winding a film which is hard to remove distortion once the distortion is memorized in the film. Such a film has flexibility, and typically it has a thickness of micrometer order (for example, 2 to 100 μm).

Generally, there are few cases where the film having an uneven thickness itself has a great influence on the quality of a final product, for example, a secondary battery. As described above, even if a film has thickness variations of about ±1 μm from a target thickness of 20 μm, such variations in the thickness of the film are unlikely to have an influence on the quality of the final product as long as the other properties of the film meet the standards. Indeed, if the film has a completely uniform thickness, it is expected that unwinding defects caused by thickness unevenness rarely occur. However, it is very difficult and impractical to reduce the variations of ±1 μm to ±0.1 μm by improving the production method of the film. According to the present invention, it is possible to prevent defects caused by the uneven thickness of the film by improving the core, instead of improving the film itself.

The film produced using an extruder equipped with a T-die is, for example, a porous resin membrane. Examples of the porous resin membrane include porous membranes made of polyolefin, fluorine resin, polyurethane, polyamide, polyester, polyimide, polyamide-imide, epoxy, and the like. Examples of polyolefin include polyethylene and polypropylene. Examples of fluorine resin include polytetrafluoroethylene. A porous resin membrane made of polyimide, polyamide-imide or epoxy may be a thermosetting membrane. These porous resin membranes can be widely used for applications such as a separator for an electrochemical device, a waterproof gas permeable membrane, a dust collecting filter, and a low dielectric substrate.

The film 18 may or may not have an adhesive layer. However, a film having no adhesive layer is more suitable for use with the core 10 of the present embodiment. Generally, once a film having an adhesive layer adheres to something, a high tension is required to remove the film. Therefore, even if the film is slightly distorted, such distortion is unlikely to cause feeding errors. In contrast, a film having no adhesive layer, more specifically, a film having slidable front and back surfaces, is often unwound at a low tension and a high speed for use. The higher the unwinding speed, the higher the probability of a feeding error. Therefore, it is particularly recommended to use the core 10 of the present embodiment as a core for a film having no adhesive layer.

Various modified configurations described below can be combined as appropriate with the core of the embodiment without departing from the essential features of the present invention.

Figure 4A:
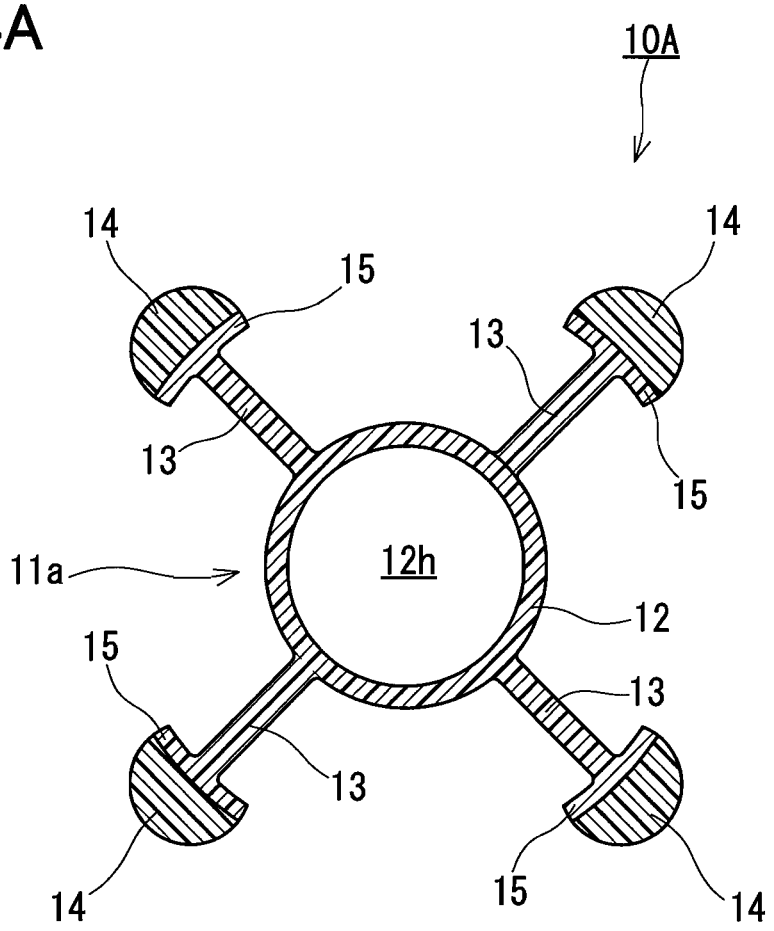
FIG. 4A is a cross-sectional view of a core according to a modification.

FIG. 4A shows a core 10A provided with a core body 11*a* including four blade portions 13.

Figure 4B:
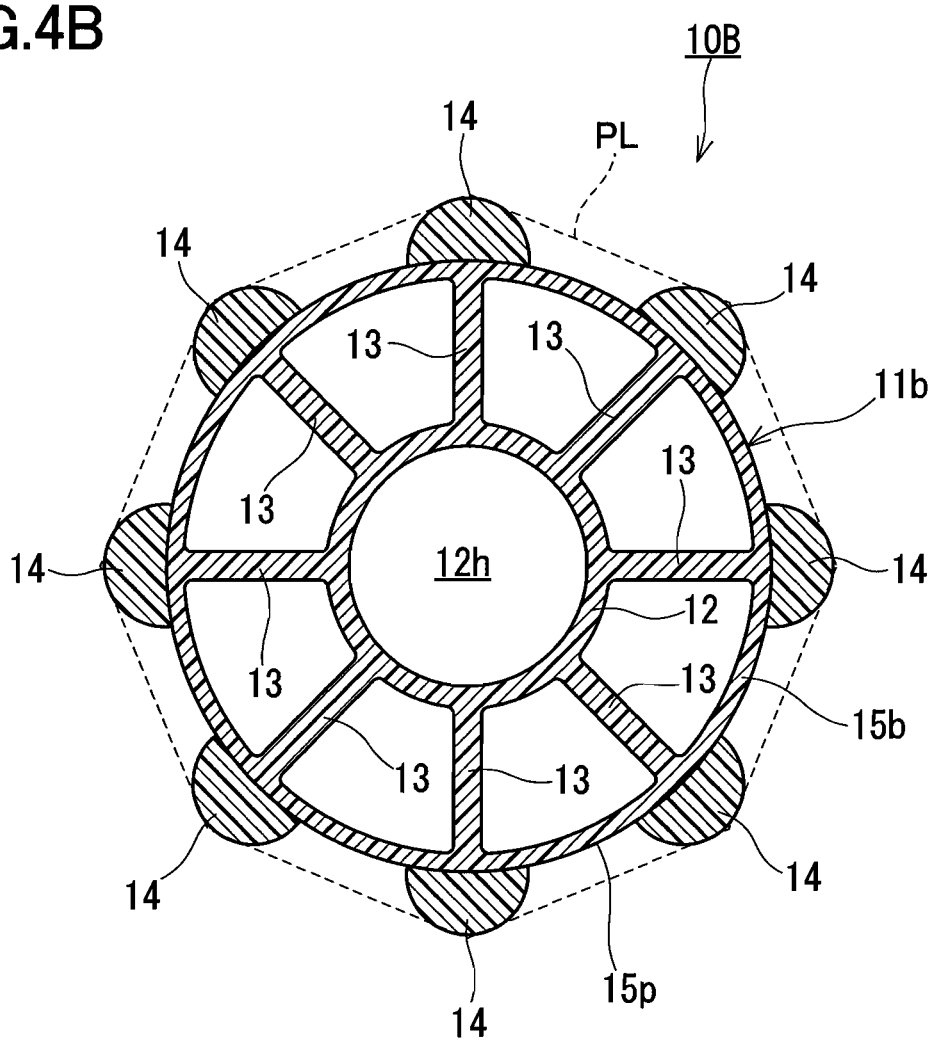
FIG. 4B is a cross-sectional view of a core according to another modification.

FIG. 4B shows a core 10B provided with a core body 11*b* including a rim portion 15*b* having a tubular shape (typically a cylindrical shape) that surrounds the bearing portion 12 in the rotational direction. That is, in this modification, only one rim portion 15*b* is provided. The rim portion 15*b* is concentrically fixed to the bearing portion 12 by the plurality of blade portions 13. The rim portion 15 configured as such makes it possible to easily form the core body 11*b* having sufficiently high rigidity. The core body 11*b* having sufficient rigidity is preferred to prevent the distortion of the film 18.

Figure 4C:
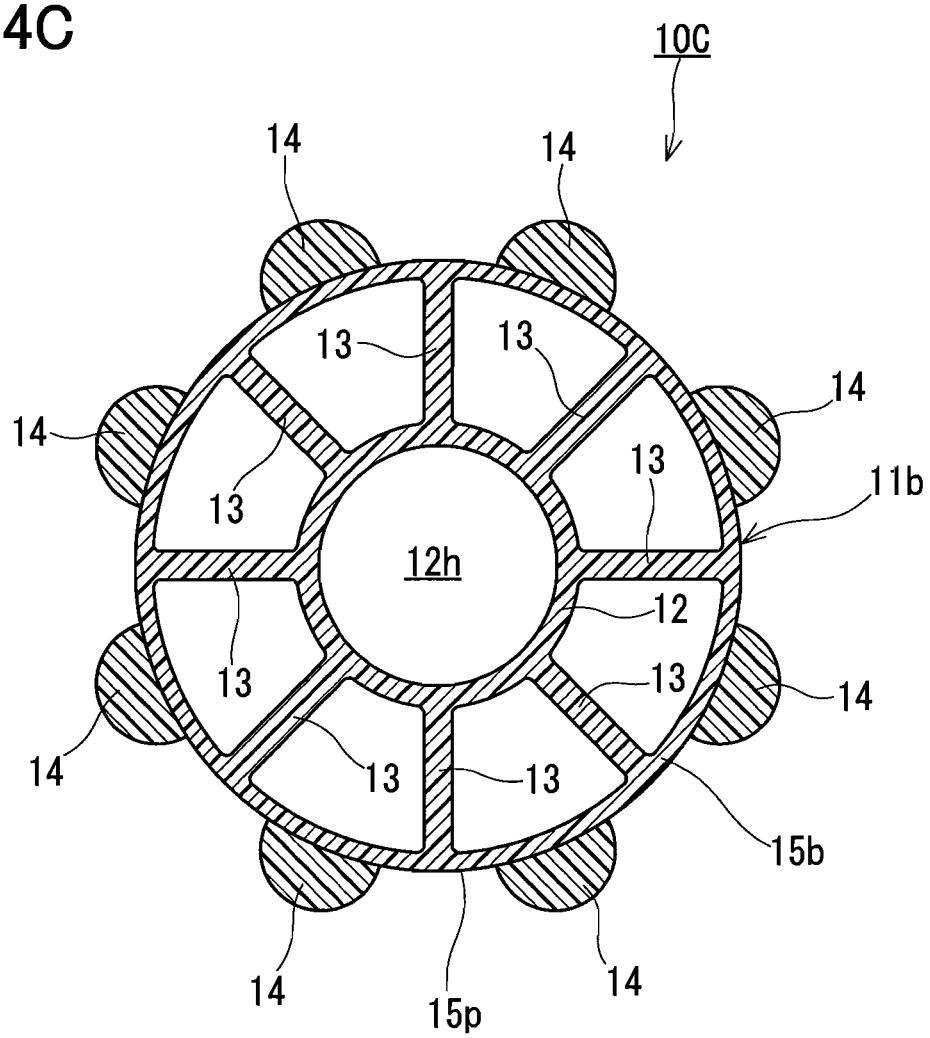
FIG. 4C is a cross-sectional view of a core according to still another modification.

In the core 10B, the film supporting portions 14 are arranged at regular intervals (regular angular intervals) in the rotational direction of the core body 11*b*. The film supporting portions 14 arranged at regular intervals in the rotational direction improves the uniformity of load on the film 18 in the longitudinal direction of the film 18. This has an advantage in suppressing the distortion. In addition, the core 10B does not limit the positions of the film supporting portions 14. For example, in a core 10C shown in FIG. 4C, the blade portions 13 and the film supporting portions 14 are arranged alternately in the rotational direction of the bearing portion 12.

As shown by a dashed line in FIG. 4B, an imaginary polygon PL having a minimum area required to surround all the film supporting portions 14 in a cross-section perpendicular to the rotational axis O is defined. The positions of the film supporting portions 14, the number of the film supporting portions 14, the height h of the film supporting portions 14 protruding from the outer peripheral surface 15*p* of the rim portion 15 can be adjusted so that the core body 11*b* fits within this polygon PL. When these requirements are satisfied, the film 18 can be prevented from being strongly pressed against the core body 11*b* (in particular, against the rim portion 15*b*).

When the film 18 is wound on the core 10B, the film 18 may be completely separated from the core body 11*b* (the rim portion 15*b*) or may be in contact with the outer peripheral surface 15*p* of the rim portion 15*b* unless the effect of suppressing the distortion decreases significantly. If gaps are formed between the core 10B and the innermost layer of the wound film 18, the effect of the present invention can be obtained.

Figure 4D:
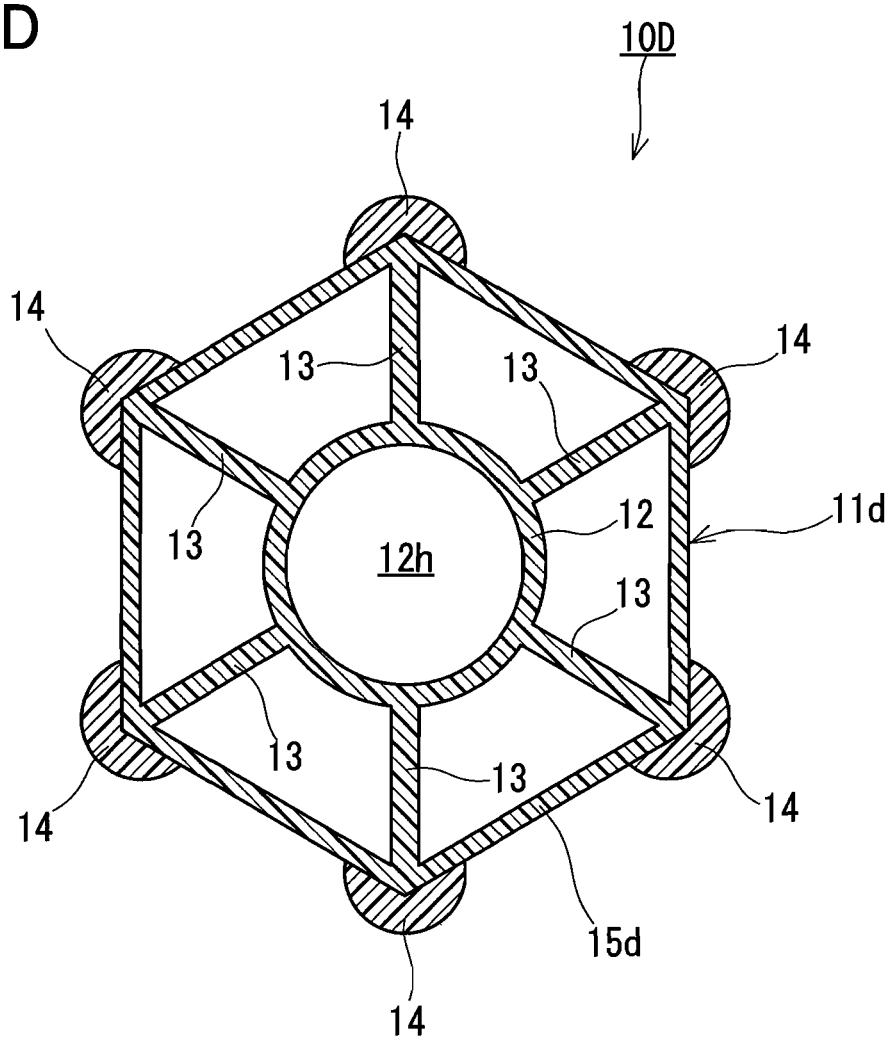
FIG. 4D is a cross-sectional view of a core according to still another modification.

FIG. 4D shows a core 10D provided with a core body 11*d* including a rim portion 15*d* having a prismatic shape. In the cross-sectional view of FIG. 4D, the rim portion 15*d* has a polygonal shape. The leading edges of the blade portions 13 and the film supporting portions 14 are located respectively at the corners of the rim portion 15*d*. When the rim portion 15*d* having a prismatic shape is used, the film supporting portions 14 can be easily positioned with respect to the rim portion 15*d*. That is, the use of the film supporting portions 14 having a shape fitted to the corners of the rim portion 15*d* makes it possible to mount the film supporting portions 14 on the rim portion 15*d* efficiently.

Figure 4E:
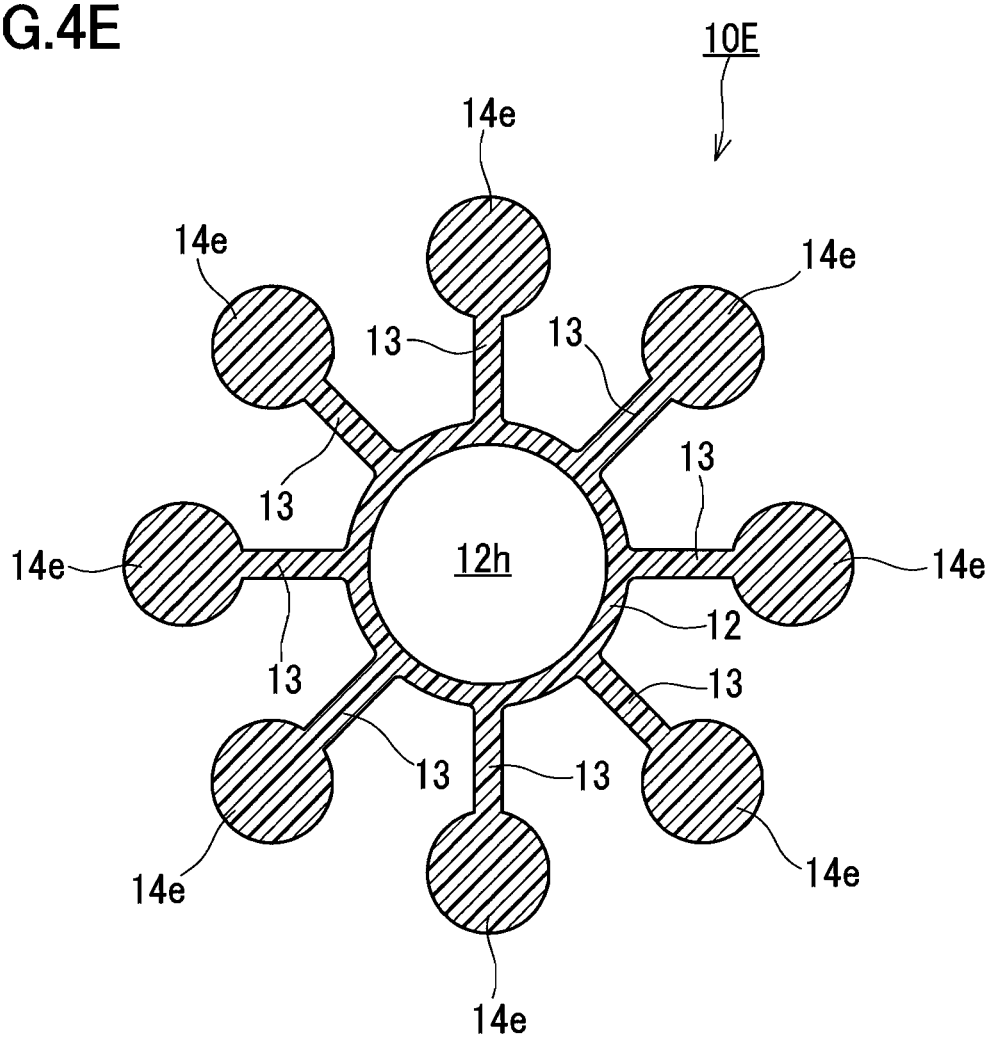
FIG. 4E is a cross-sectional view of a core according to still another modification.

FIG. 4E shows a core 10E having film supporting portions 14*e* made of the same resin as that of the bearing portion 12 and the plurality of blade portions 13. The core 10E does not have a rim portion, and the film supporting portions 14*e* are connected directly to the blade portions 13. This core 10E is formed as a single component. Therefore, the work for mounting the film supporting portions 14*e* to the blade portions 13 can be omitted.

In the core 10E, the film supporting portions 14*e* may be made of a different material from that of the bearing portion 12 and the blade portions 13. For example, according to a known two-color molding technique, it is possible to form the bearing portion 12 and the blade portions 13 using a first resin which is relatively hard at room temperature and to form the film supporting portions 14*e* using a second resin which is relatively soft at room temperature.

Figure 4F:
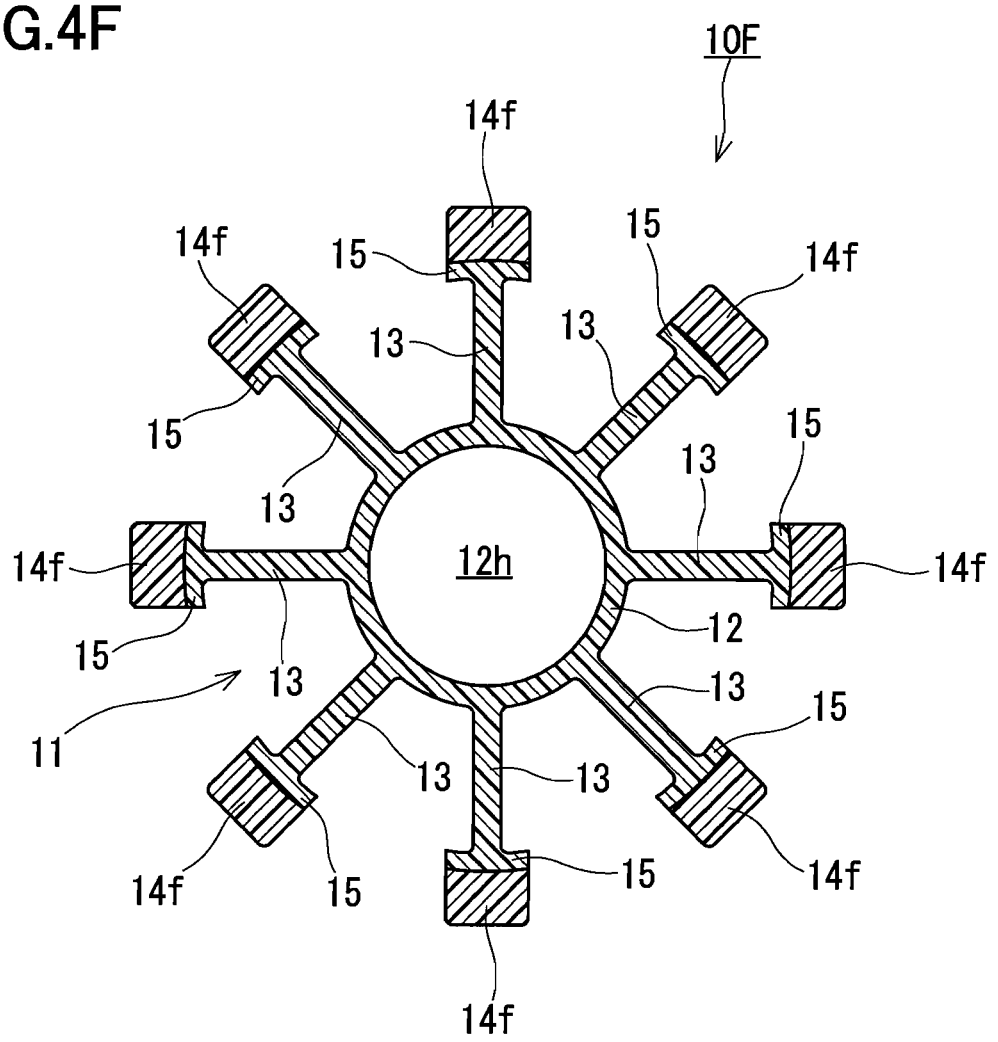
FIG. 4F is a cross-sectional view of a core according to still another modification.
Figure 4G:
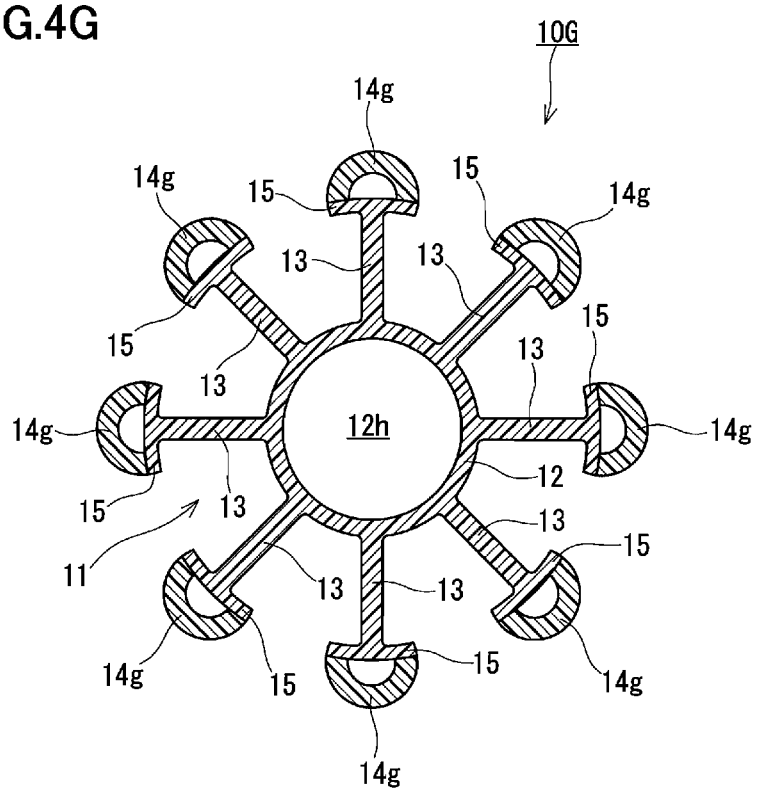
FIG. 4G is a cross-sectional view of a core according to still another modification.

FIG. 4F shows a core 10F provided with film supporting portions 14*f* having a rectangular column shape. FIG. 4G shows a core 10G provided with film supporting portions 14*g* having a hollow semicircular column shape. These film supporting portions 14*f* and 14*g* also can be suitably employed because they perform the same action as the film supporting portions 14. In particular, since the film supporting portions 14*g* having a hollow structure as shown in FIG. 4G can be easily elastically deformed, the effect of alleviating or offsetting the influence of the uneven thickness of the film 18 can be expected sufficiently. In the cross-section perpendicular to the rotational axis O, the outer peripheral surface of the film supporting portion 14 or 14*g* has a smaller curvature than that of the outer peripheral surface of the bearing portion 12.

The invention claimed is:

1. A film winding core on which a long film is to be wound, comprising:

a tubular bearing portion into which a shaft used to rotate the film winding core is to be inserted;

a plurality of blade portions provided respectively at a plurality of positions in a rotational direction of the bearing portion, the plurality of blade portions respectively extending outwardly from the bearing portion so as to partition a space around the bearing portion in the rotational direction;

a plurality of film supporting portions respectively provided at positions outward from leading edges of the blade portions, the plurality of film supporting portions having an outwardly protruding shape so that the film is supported away from the film winding core between the film supporting portions that are adjacent to each other in the rotational direction, and a rim portion located on the leading edges of the blade portions, the rim portion having a tubular shape that surrounds the bearing portion in the rotational direction, wherein the film supporting portions are fixed to the rim portion, the rim portion is fixed to the bearing portion by the blade portions, each of the blade portions has a rectangular plate shape, the rim portion is located on one side of the blade portions, and the bearing portion is located on another side of the blade portions, both the film supporting portions and the blade portions extend from one side of the bearing portion to another side of the bearing portion in a direction parallel to a rotational axis of the film winding core, and the bearing portion, the blade portions, the rim portion, and the film supporting portions have a same length in the direction parallel to the rotational axis.

2. The film winding core according to claim 1, wherein the bearing portion and the blade portions are integrated with each other.

3. The film winding core according to claim 1, wherein the film supporting portions are each made of a material that can be deformed when the film is wound on the film winding core.

4. The film winding core according to claim 3, wherein the material is an elastically deformable material.

5. The film winding core according to claim 3, wherein the material comprises at least one selected from the group consisting of sponge, rubber, and foam.

6. The film winding core according to claim 3, wherein the material is urethane foam.

7. The film winding core according to claim 1, wherein a longitudinal direction of each of the film supporting portions is parallel to the rotational axis of the film winding core.

8. The film winding core according to claim 1, wherein each of the film supporting portions has a shape of a semicircular column, a rectangular column, or a hollow semicircular column.

9. A wound film body comprising:

the film winding core according to claim 1; and a film wound on the film winding core.

10. The wound film body according to claim 9, wherein the film is a porous resin membrane.

11. The film winding core according to claim 1, wherein the rim portion has a polygonal shape in a cross-section perpendicular to the rotational axis of the film winding core, the polygonal shape defining corners, the leading edges of the blade portions and the film supporting portions are located respectively at the corners of the rim portion, and the film supporting portions have a shape fitted to the corners of the rim portion.

* * * * *